US005694873A

United States Patent [19]

Wu

[11] Patent Number: 5,694,873

[45] Date of Patent: Dec. 9, 1997

[54] NON-SUSPENSION TYPE THREAD FEEDER FOR SEWING MACHINE

[76] Inventor: Jui Yi Wu, No. 298, Ming Shing Street, Qui Shan Hsiang, Tao Yuan Hsien, Taiwan

[21] Appl. No.: 763,629

[22] Filed: Dec. 4, 1996

[51] Int. Cl.[6] ..... D05B 43/00

[52] U.S. Cl. ..... 112/302; 242/130.1; 242/131; 242/130.4; 242/156.2; 242/597.7

[58] Field of Search ..... 112/302, 80.77, 112/80.7, 217.1, 258, 279; 242/594.5, 597.5, 597.7, 131, 599.3, 129.8, 130, 130.1, 130.3, 130.4, 156.2, 421.3; 8/154; 19/149; 28/176, 193; 53/430; 57/58.67, 303, 305, 313; 66/151; 223/106

[56] References Cited

U.S. PATENT DOCUMENTS

| | | | |
|---|---|---|---|
| 1,730,431 | 10/1929 | Keefer | 242/130 X |
| 1,779,778 | 10/1930 | Nelson | 242/597.7 X |
| 1,822,765 | 9/1931 | Dickey | 112/302 |
| 2,528,171 | 10/1950 | Pehlivanian | 112/302 |
| 2,610,599 | 9/1952 | Piccano et al. | 112/302 |
| 4,039,159 | 8/1977 | Champagne | 242/130.1 |
| 4,106,723 | 8/1978 | Couture | 242/130 X |
| 4,634,077 | 1/1987 | Wilson | 242/130 X |
| 5,626,302 | 5/1997 | Hrobar | 242/597.7 X |

*Primary Examiner*—Ismael Izaguirre
*Attorney, Agent, or Firm*—Bacon & Thomas

[57] ABSTRACT

A non-suspension type thread feeder including a rack post fixedly secured to a part of a sewing machine, a hollow, truncated, split cone revolvably and vertically adjustably mounted on the rack post to hold a spool of thread, the hollow, truncated, split cone being synchronously turned with the spool of thread when the thread of the spool of thread is pulled.

7 Claims, 13 Drawing Sheets

NON-SUSPENSION TYPE THREAD FEEDER FOR SEWING MACHINE

BACKGROUND OF THE INVENTION

The present invention relates to thread feeders for sewing machines, and more particularly to a non-suspension type thread feeder which is combined with the bobbin thread take-up wheel of the sewing machine into a unit and, which keeps the thread stretched when sewing.

Regular sewing machines, knitting machines, weaving machines, etc., are commonly equipped with a thread feeder for feeding a thread or threads. FIG. 1 shows a thread feeder for a sewing machine according to the prior art. The thread feeder comprises a rack post 10, a rack 11 fastened to the rack post 10 in the middle to hold two plates 12, 13 and two spools of thread 14, 15 on the plates 12, 13, a suspension arm 16 fastened to the rack post 10 near the top and having two thread holes 17, 18 through which the threads 140, 150 of the spools of thread 14, 15 are inserted and then respectively connected to the needle 100 and the bobbin thread take-up wheel 19. Because the threads 140, 150 are suspended from the suspension arm 16, the thread 140 which is connected to the needle 10 tends to be forced or twisted to tangle, causing the stitching operation unable to be performed smoothly. Because the threads 140, 150 are respectively pulled upwards from the respective spools of thread 14, 15, the spools of thread 14, 15 are not turned to let off the threads 140, 150 when the threads 140, 150 are pulled, therefore the threads 140, 150 cannot be smoothly pulled out of the respective spools of thread 14, 15. Furthermore, because the rack post 10 is mounted on the top of the sewing table in one corner, and the rack 11 and the suspension arm 16 are respectively and perpendicularly fastened to the rack post 10, much installation space is required, and the sense of beauty of the sewing machine is destroyed.

SUMMARY OF THE INVENTION

It is one object of the present invention to provide a non-suspension thread feeder which keeps the thread stretched when sewing, so that the thread is prohibited from being tangled. It is another object of the present invention to provide a non-suspension thread feeder which requires less storage and installation space. It is still another object of the present invention to provide a non-suspension thread feeder which does not affect the sense of beauty of the sewing machine when installed. According to one aspect of the present invention, the non-suspension type thread feeder comprises a rack post fixedly secured to a part of a sewing machine, and a hollow, truncated, split cone revolvably and vertically adjustably mounted on the rack post to hold a spool of thread. The hollow, truncated, split cone is synchronously turned with the spool of thread when the thread of the spool of thread is pulled. According to another aspect of the present invention, an adjustable tension device is fastened to the rack post to impart a pressure to the hollow, truncated, split cone, therefore the tension of the thread can be adjusted.

DETAILED DESCRIPTION OF THE PREFERRED EMBODIMENT

Figure 1:
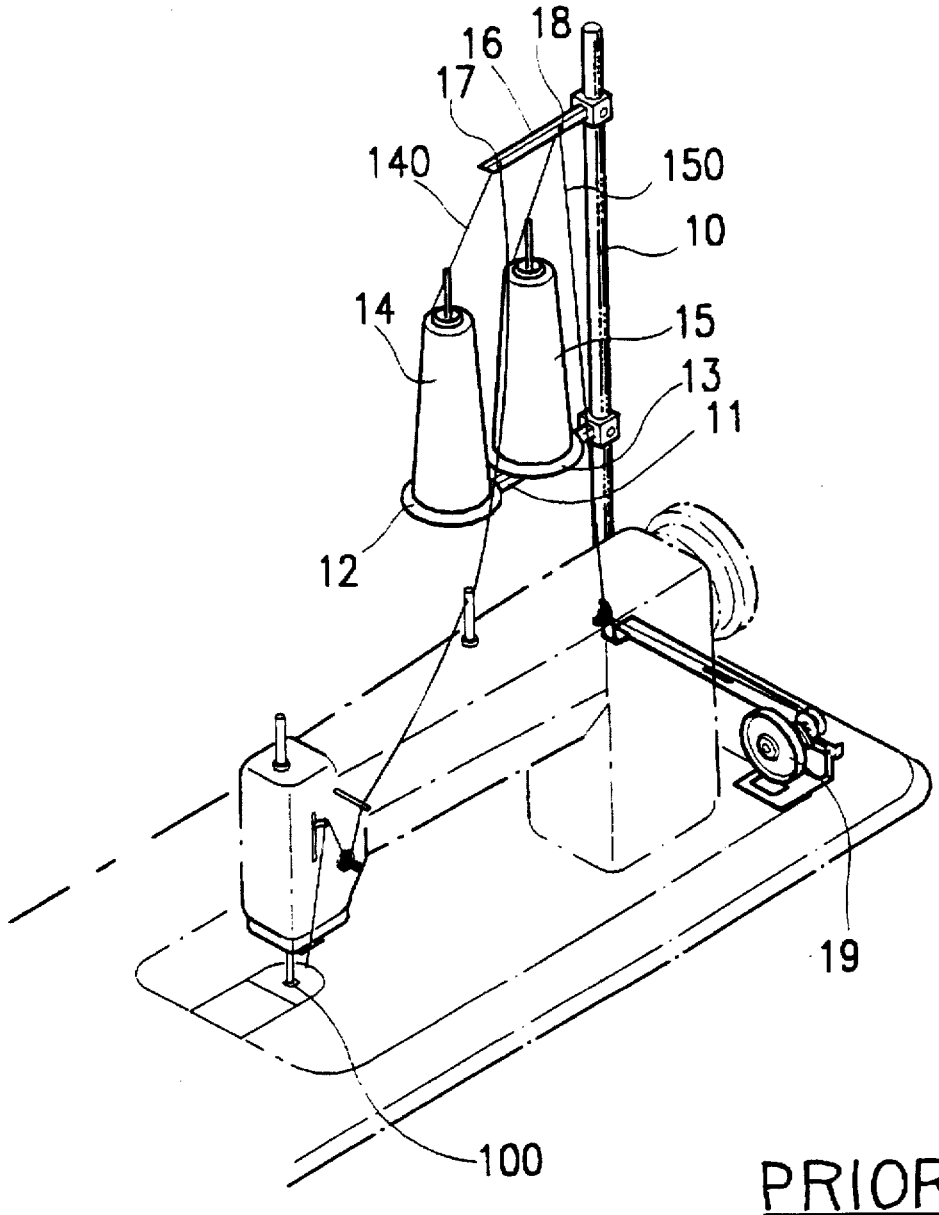
PRIOR ART FIG. 1
FIG. 1 shows a suspension type thread feeder installed in a sewing machine according to the prior art.
Figure 2:
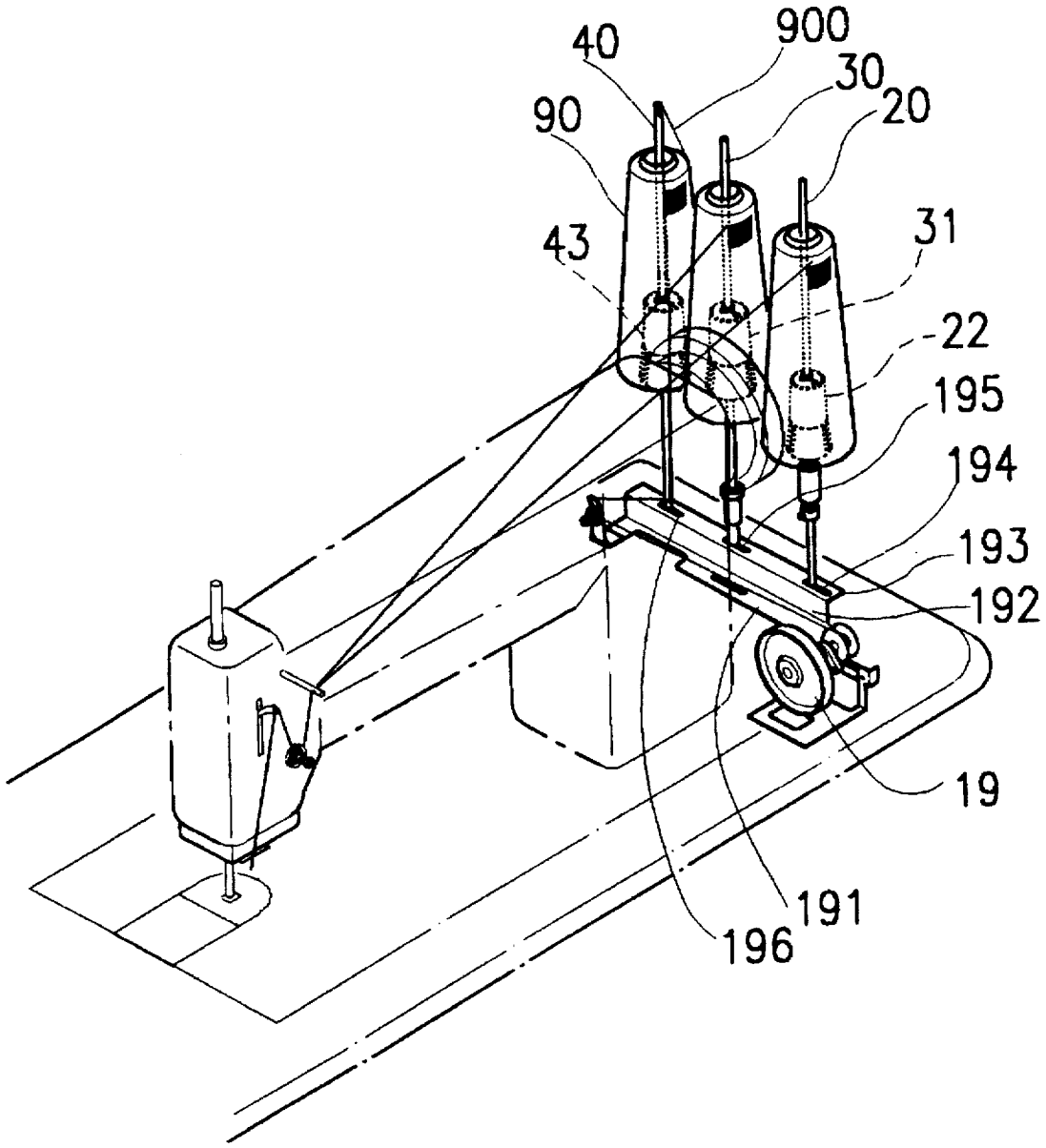
FIG. 2 is a perspective view of a non-suspension type thread feeder installed in a sewing machine according to the present invention.
Figure 3:
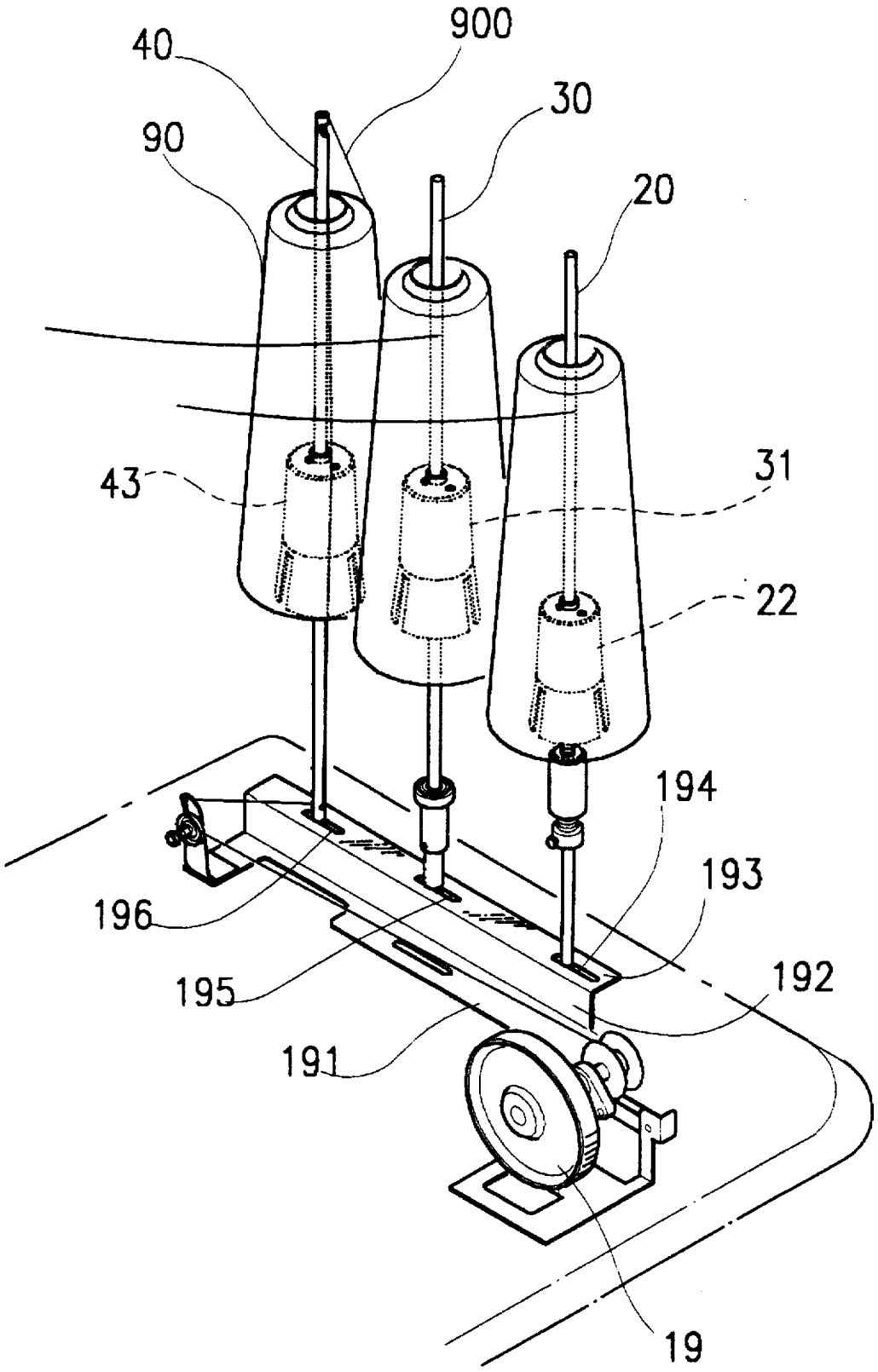
FIG. 3 is an enlarged view of the non-suspension type thread feeder shown in FIG. 2.
Figure 4:
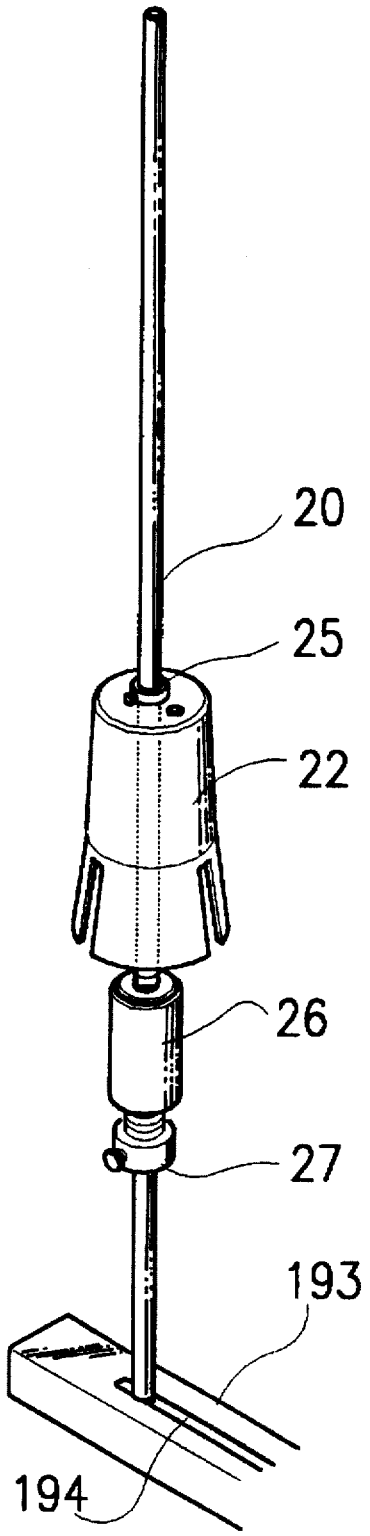
FIG. 4 is a perspective elevational view of a part of the present invention, showing one rack post fastened to one elongated slot of the horizontal supporting wall, and one hollow, truncated, split cone fastened to the rack post.
Figure 5:
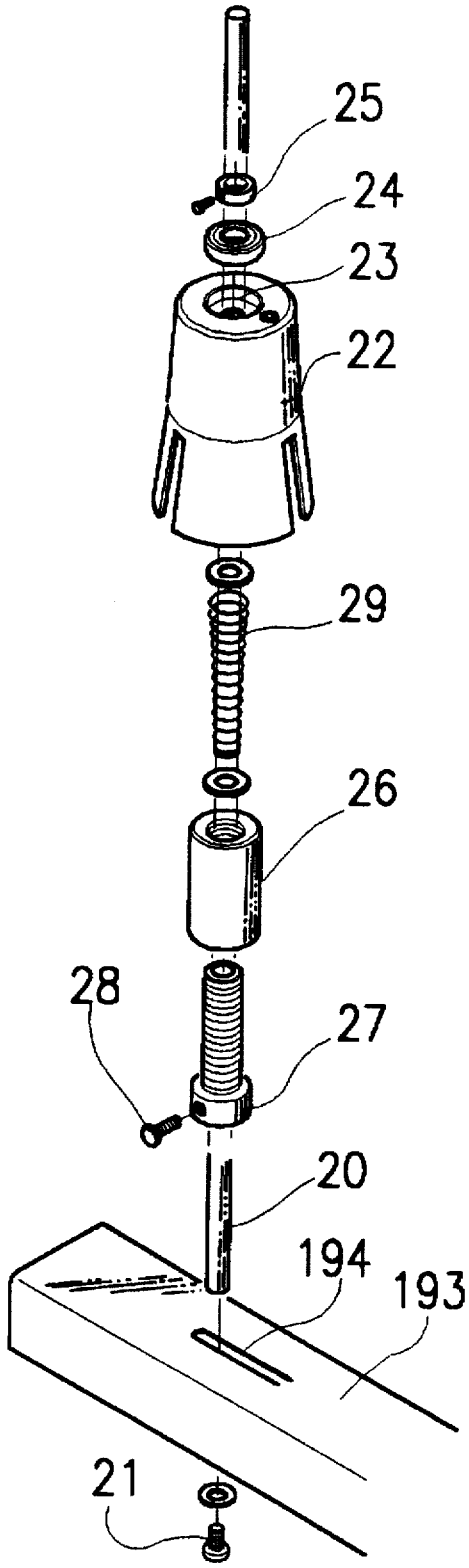
FIG. 5 is an exploded view of FIG. 4.
Figure 6:
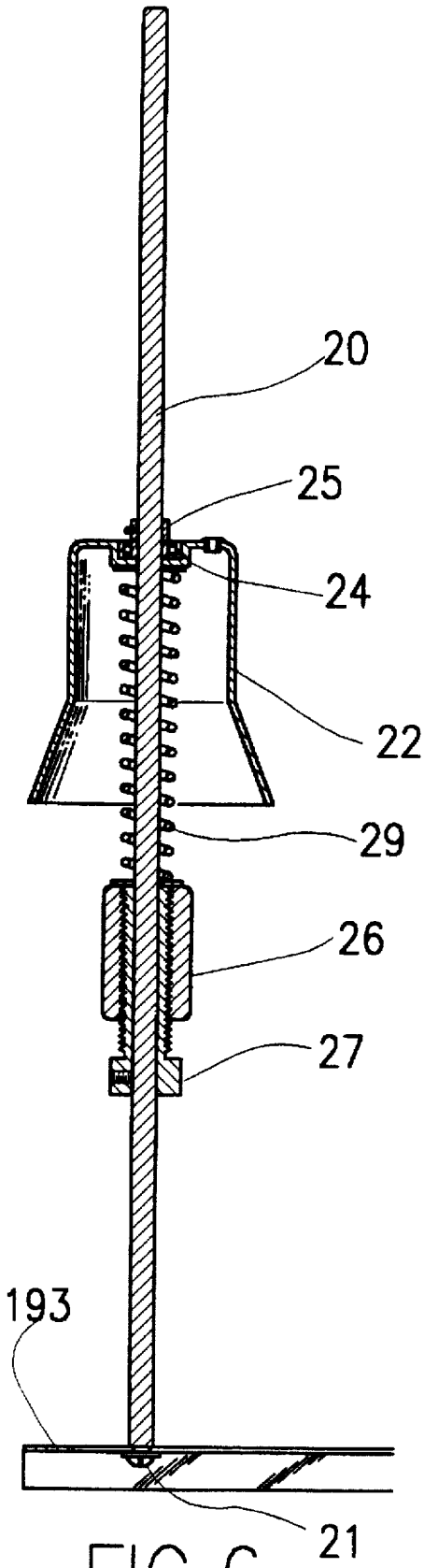
FIG. 6 is sectional view of FIG. 4.
Figure 7:
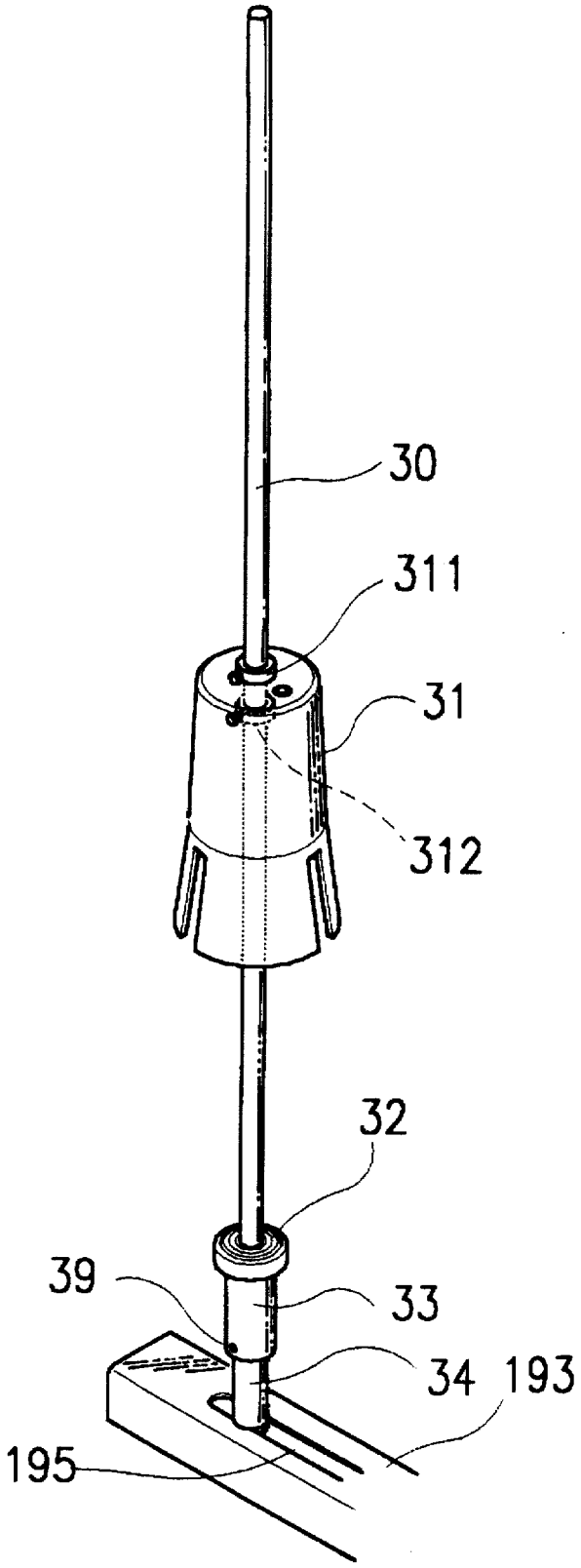
FIG. 7 is a perspective elevational view of another part of the present invention, showing a locating rod fastened to a second elongated slot of the horizontal supporting wall, a second rack post supported in a rack post holder on the locating rod, and a second hollow, truncated, split cone fastened to the second rack post.
Figure 8:
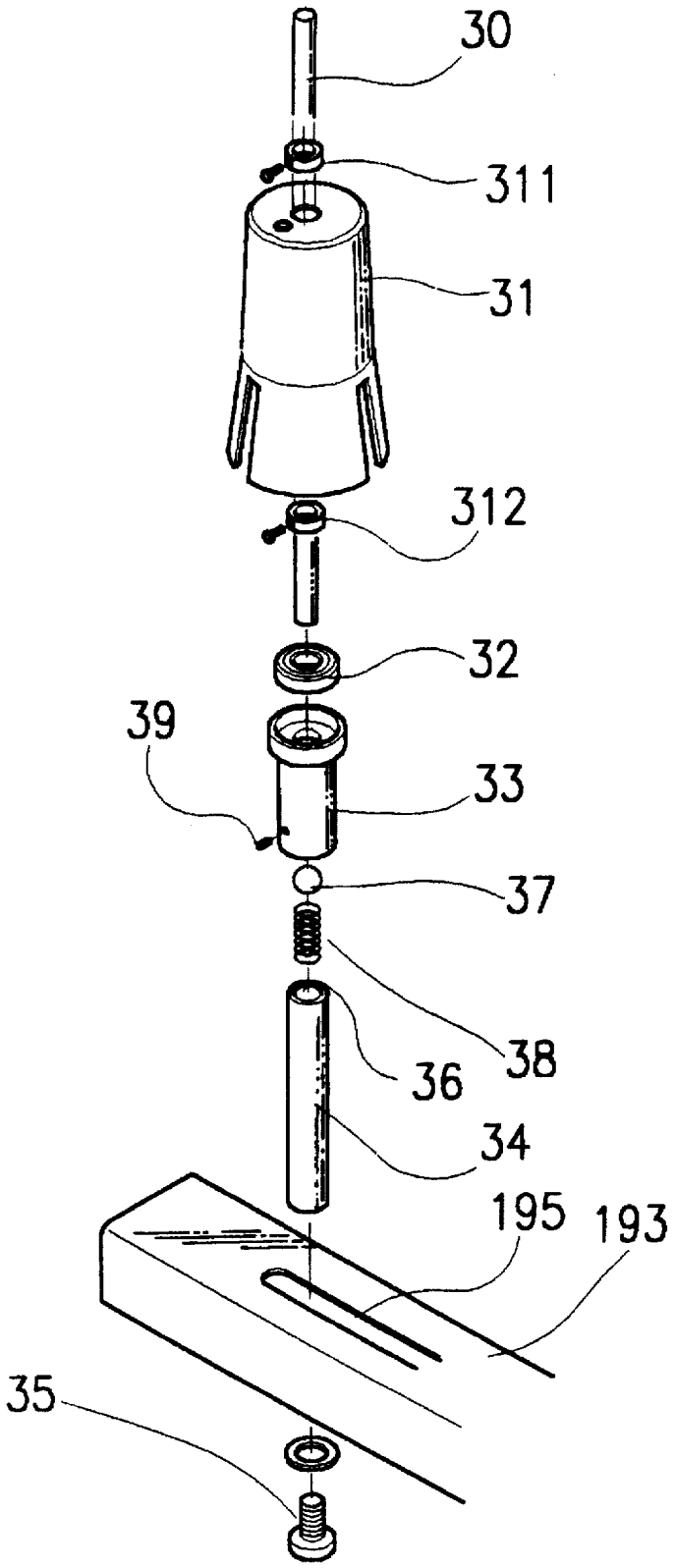
FIG. 8 is an exploded view of FIG. 7.
Figure 9:
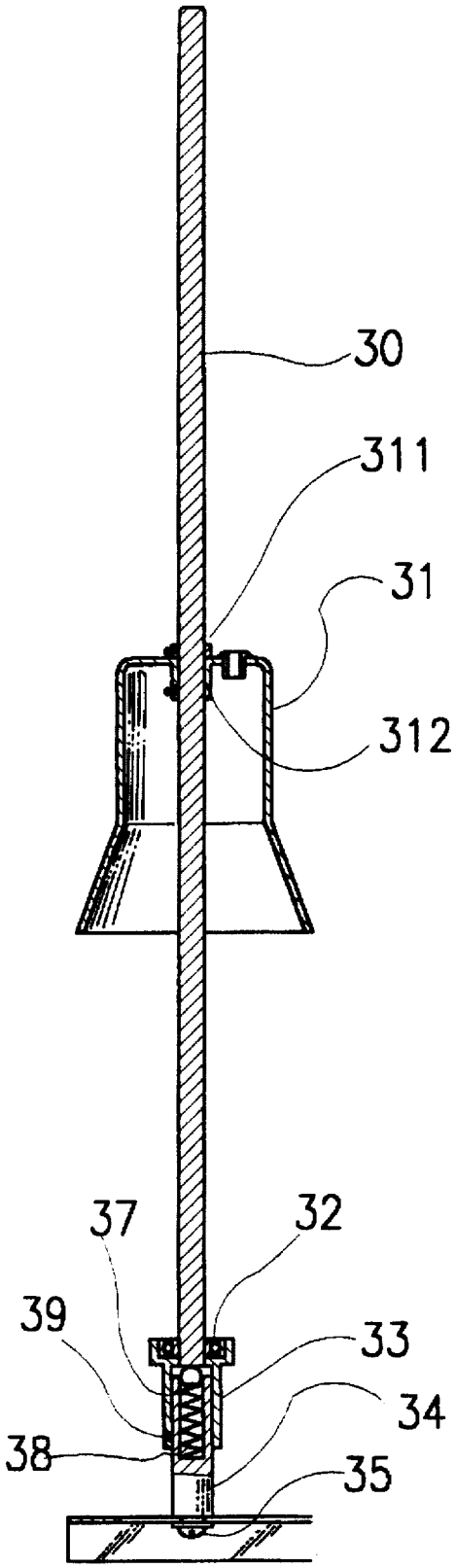
FIG. 9 is a sectional view of FIG. 7.
Figure 10:
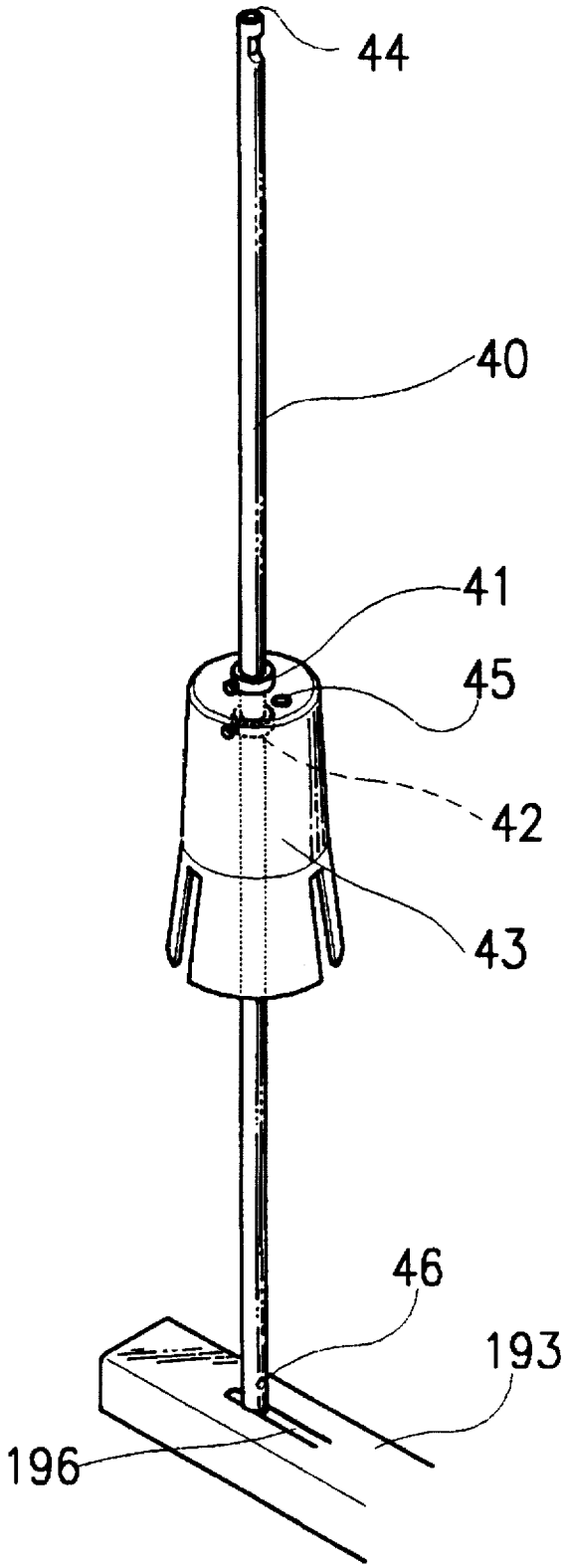
FIG. 10 is a perspective elevational view of still another part of the present invention, showing a third rack post fastened to a third elongated slot of the horizontal supporting wall, and a third hollow, truncated, split cone with an eccentric through hole fastened to the third rack post.
Figure 11:
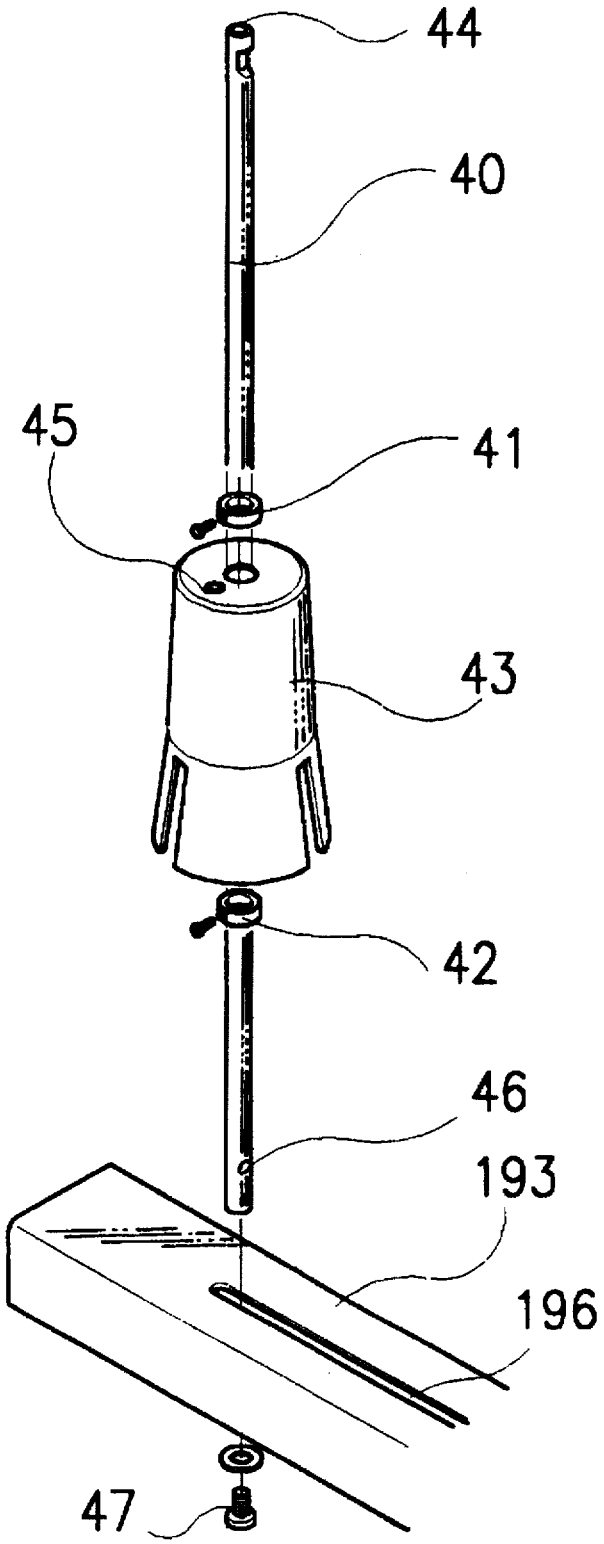
FIG. 11 is an exploded view of FIG. 10.
Figure 12:
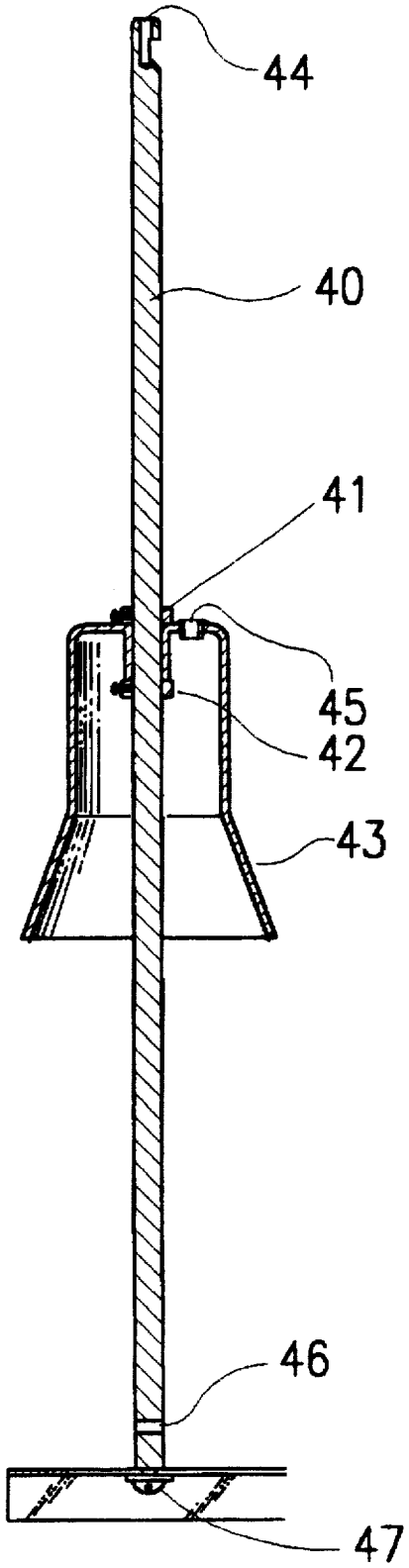
FIG. 12 is a sectional view of FIG. 10.
Figure 13:
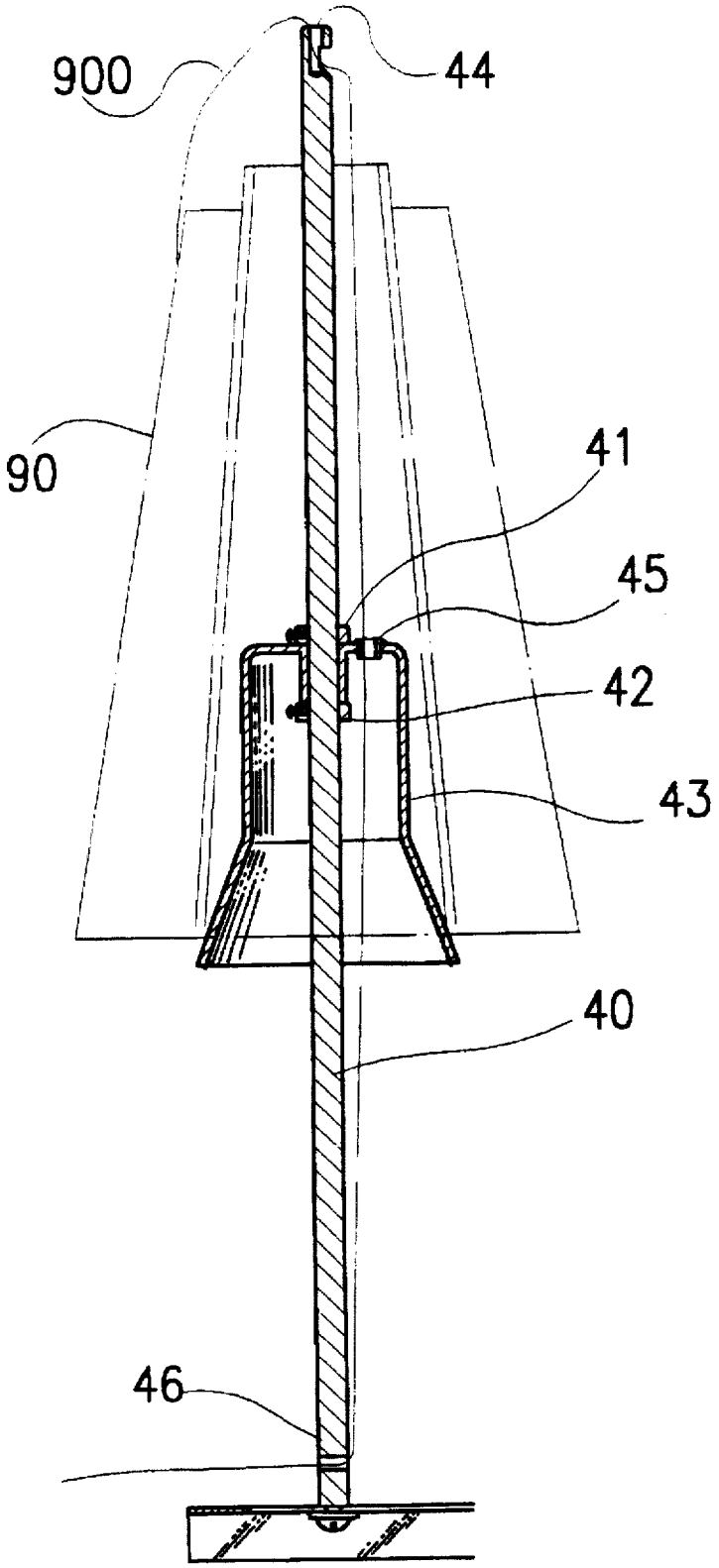
FIG. 13 is similar to FIG. 12 but showing the thread of the corresponding spool of thread inserted through the top through hole and transverse through hole of the third rack post via the eccentric through hole of the third hollow, truncated, split cone.

Referring to FIGS. 2 and 3, a metal mounting frame 191 of a bobbin thread take-up wheel 19 is shown, having a channel frame section comprised of an upright wall 192, and a horizontal supporting wall 193 extended from the upright wall 192 at the top at right angles. The horizontal supporting wall 193 has a plurality of elongated slots 194, 195, 196 longitudinally arranged in a line. A plurality of rack posts 20, 30, 40 are respectively mounted in the elongated slots 194, 195, 196.

Referring to Figures from 4 to 6, the rack post 20 has a bottom end inserted through one elongated slot 194 of the horizontal supporting wall 193, and secured thereto by a screw 21. A hollow, truncated, split cone 22 is mounted around the rack post 20, having a top recess 23 at the center of the flat top thereof. A bearing 24 is mounted within the top recess 23 of the hollow, truncated, split cone 22 around the rack post 20, and secured in place by a locating ring 25. A hollow screw 27 is mounted around the rack post 20 below the hollow, truncated, split cone 22, and fixed in place by a tightening up screw 28. A cylindrical nut 26 is mounted around the rack post 20, and threaded onto the hollow screw 27 from the top. A spring 29 is mounted around the rack post 20, and stopped between the cylindrical nut 26 and the flat top of the hollow, truncated, split cone 22. By turning the cylindrical nut 26 on the hollow screw 27, the tension of the spring 29 is relatively adjusted, and therefore the tension of the spool of thread which is mounted on the hollow, truncated, split cone 22, is relatively adjusted.

Referring to Figures from 7 to 9, the a hollow, truncated, split cone 31 is mounted around the rack post 30, and revolvably secured in place by locating rings 311,312. A locating rod 34 is fastened to one elongated slot 195 of the horizontal supporting wall 193 by a screw 35, having a top hole 36, which holds a spring 38, and a steel ball 37 on the spring 38. A hollow, cylindrical rack post holder 33 is mounted around the locating rod 34 and fixed thereto at the desired elevation by a tightening up screw 39 to hold a bearing 32 and the bottom end of the rack post 30 in the bearing 32. Because the rack post 30 is mounted in the bearing 32 and supported on the steel ball 37 above the spring 38, less tension is employed to the spool of thread which is mounted on the hollow, truncated, split cone 31.

Referring to Figures from 10 to 13, a rack post 40 is fastened to one elongated slot 196 of the horizontal supporting wall 193 by a screw 47, having a top through hole 44, and a transverse through hole 46 near the bottom end above the horizontal supporting wall 193; a hollow, truncated, split cone 43 is mounted around the rack post 40 and revolvably retained in place by locating rings 41, 42, having an eccentric through hole 45. The thread 900 of the spool of thread 90, which is mounted on the hollow, truncated, split cone 43, is inserted through the top through hole 44 of the rack post 40, the eccentric through hole 45 of the hollow, truncated, split cone 43, and the transverse through hole 46 of the rack post 40.

According to the aforesaid non-tension, low-tension, and high-tension embodiments, when the thread is pulled out, the hollow, truncated, Split cone is synchronously rotated with the spool of thread. Because the thread is pulled out in a direction tangent to the spool of thread, no suspension means is required to support and guide the thread. Different tension can be employed to the hollow, truncated, split cone and the spool of thread mounted thereon, so that the thread can be fed smoothly. Because the whole structure is made with the bobbin thread take-up wheel of the sewing machine in a unit, less installation space is needed, and the dimension of the machine can be minimized.

What the invention claimed is:

1. A non-suspension type thread feeder comprising at least one rack post fixedly secured to a part of a sewing machine, at least one hollow, truncated, split cone respectively turned about and moved along said at least one rack post and adapted for holding a spool of thread, locating means respectively fastened to said at least one rack post to hold said at least one hollow, truncated, split cone at the desired elevation, permitting said at least one hollow, truncated, split cone to be respectively and synchronously turned with said at least spool of thread when the thread of each of said at least one spool of thread is pulled.

2. The non-suspension type thread feeder of claim 1 wherein each of said at least one rack post is fixedly fastened to a metal mounting frame of a bobbin thread take-up wheel of the sewing machine.

3. The non-suspension type thread feeder of claim 2 wherein the metal mounting frame of said bobbin thread take-up wheel comprises a channel frame section, which holds said at least one rack post.

4. The non-suspension type thread feeder of claim 3 wherein said channel frame section has at least one elongated slot adapted for holding said at least one rack post respectively.

5. The non-suspension type thread feeder of claim 1 wherein said at least one rack post includes a first rack post having a L-shaped top through hole and a radial bottom through hole adapted for guiding the thread of the spool of thread, which is mounted on the corresponding hollow, truncated, split cone; said at least one hollow, truncated, split cone includes a first hollow, truncated, split cone mounted around said first rack post, having an eccentric through hole disposed outside said first rack post and adapted for guiding the thread of the corresponding spool of thread which passes through the L-shaped top through hole and radial bottom through hole of aid first rack post.

6. The non-suspension type thread feeder of claim 1 wherein said at least one rack post includes a first rack post mounted in a bearing within a rack post holder and supported on a steel ball above a spring in a top hole of a locating rod, which holds said rack post holder and is fastened to a part of the sewing machine.

7. The non-suspension type thread feeder of claim 1 wherein said at least one hollow, truncated, split cone includes a first hollow, truncated, split cone mounted on a bearing around the corresponding rack post and supported on a spring above a cylindrical nut, which is threaded onto a hollow screw, which is mounted around the corresponding rack post and fixed thereto by a tightening up screw.

* * * * *